US007088293B2

(12) United States Patent
Imaizumi et al.

(10) Patent No.: US 7,088,293 B2
(45) Date of Patent: Aug. 8, 2006

(54) COMMUNICATION APPARATUS

(75) Inventors: Tatsuya Imaizumi, Nakamuroda Haruna-Machi (JP); Junichi Ikeda, Nakamuroda Haruna-Machi (JP)

(73) Assignee: Taiyo Yuden Co., Ltd., Gunma (JP)

( * ) Notice: Subject to any disclaimer, the term of this patent is extended or adjusted under 35 U.S.C. 154(b) by 15 days.

(21) Appl. No.: 10/938,734

(22) Filed: Sep. 10, 2004

(65) Prior Publication Data

US 2005/0057407 A1 Mar. 17, 2005

(30) Foreign Application Priority Data

Sep. 11, 2003 (JP) ..... 2003-320110

(51) Int. Cl.
*H01Q 1/24* (2006.01)

(52) U.S. Cl. ..... 343/702

(58) Field of Classification Search ..... 343/700 MS, 343/702, 795

See application file for complete search history.

(56) References Cited

U.S. PATENT DOCUMENTS 6,104,349 A * 8/2000 Cohen ..... 343/702
6,236,367 B1 * 5/2001 Du Toit et al. ..... 343/700 MS
6,429,818 B1 * 8/2002 Johnson et al. ..... 343/702
6,452,553 B1 * 9/2002 Cohen ..... 343/702
6,812,893 B1 * 11/2004 Waterman ..... 343/700 MS
6,937,193 B1 * 8/2005 Hendler et al. ..... 343/700 MS
2002/0015000 A1 * 2/2002 Reece et al. ..... 343/795

OTHER PUBLICATIONS

Shawn Rogers, et al., Artificial Magnetic Conductor (AMC) Technology Enables the Coexistence of 802.11b and Bluetooth, published by eTENNA, pp. 1-6, Revision B Feb. 14, 2003.

* cited by examiner

*Primary Examiner*—Wilson Lee
*Assistant Examiner*—Hung Tran Vy
(74) *Attorney, Agent, or Firm*—Knobbe Martens Olson & Bear, LLP

(57) ABSTRACT

A communication apparatus includes a first antenna device connected to a first communication circuit and a first antenna ground, and a second antenna device connected to a second communication circuit and a second antenna ground. The direction in which the first antenna device resonates is away from the direction in which the second antenna device resonates. The first antenna device is provided with a first waveguide passive element which is radiation-coupled with the first antenna device. The second antenna device is provided with a second waveguide passive element which is radiation-coupled with the second antenna device. Because of the function of the first and second passive elements, radio interference between the first antenna device and the second antenna device installed in the communication apparatus can be reduced.

23 Claims, 8 Drawing Sheets

COMMUNICATION APPARATUS

BACKGROUND OF THE INVENTION

1. Field of the Invention

The present invention relates to communication apparatuses, and particularly to a communication apparatus equipped with two antennas used for two different communication systems.

2. Description of the Related Art

Typical communication apparatuses include mobile terminals, such as personal digital assistants (PDAs), and notebook personal computers (hereinafter sometimes referred to as "PCs"). Many PCs have Bluetooth®, which is used for wirelessly connecting mice or keyboards, or wireless local area networks (LANs), which are used for wirelessly connecting PCs to printers or other PCs. For Bluetooth® or IEEE802.11b wireless LAN communication, which is currently the most commonly used, the 2.4 GHz telephone band is used. For higher-data rate IEEE802.11g, which will come into widespread use in the near future, the 2.4 GHz band is also used. Accordingly, if Bluetooth® and a wireless LAN are used at the same time, radio interference may occur, and countermeasures against such interference must be taken.

To solve this problem, an artificial magnetic conductor (AMC) has been developed by Etenna Corporation in the United States. The AMC is formed by modifying a known magnetic conductor to shield it from surface waves.

However, the AMC is cumbersome, heavy, and expensive since it is formed by modifying a known magnetic conductor.

SUMMARY OF THE INVENTION

Accordingly, in an aspect, it is an object of the present invention to provide a very lightweight, simple, and/or inexpensive communication apparatus that can minimize radio interference even with a plurality of communication circuits, such as Bluetooth® and wireless LANs, and antennas.

After being committed to a study to achieve the above-described object, the present inventors discovered that the null points of a pair of antenna devices can be emphasized by providing a waveguide passive elementpassive element for each of the pair of antenna devices, which is very effective in suppressing radio interference between the two antenna devices. The present invention has been made based on this discovery.

In order to achieve the above-described object, in an aspect, the present invention provides a communication apparatus including: a first antenna device connected to a first communication circuit and a first antenna ground; and a second antenna device connected to a second communication circuit and a second antenna ground. In this communication apparatus, the direction in which the first antenna device resonates is away from the direction in which the second antenna device resonates. The first antenna device is provided with a first waveguide passive elementpassive element which is radiation-coupled with the first antenna device. The second antenna device is provided with a second waveguide passive elementpassive element which is radiation-coupled with the second antenna device.

With this configuration, the first communication circuit performs communication by using the first antenna device and the first antenna ground. The second communication circuit performs communication by using the second antenna device and the second antenna ground. Because of the action of the first and second passive elementpassive elements, radio interference between the first antenna device and the second antenna device can be effectively suppressed. Accordingly, even if the resonant frequency band of the first antenna device is close to that of the second antenna device, both the resonant frequency bands can be used at the same time.

In the aforementioned communication apparatus, the first passive elementpassive element may be formed generally in an inverted-L shape including a long portion and a short portion, the long portion extending along the plane of the first antenna ground and the short portion extending in parallel with the second antenna device. The second passive elementpassive element may be formed generally in an inverted-L shape including a long portion and a short portion, the long portion extending along the plane of the second antenna ground and the short portion extending in parallel with the first antenna device.

In the above-described communication apparatus, the first passive elementpassive element may be disposed so that the long portion of the first passive element is orthogonal to the direction in which the first antenna device resonates. The second passive element may be disposed so that the long portion of the second passive element is orthogonal to the direction in which the second antenna device resonates.

In the aforementioned communication apparatus, the first passive element may be formed generally in an inverted-J shape including a long portion and a short portion, the first antenna device being disposed in a space between the long portion and the short portion of the first passive element. The second passive element may be formed generally in an inverted-J shape including a long portion and a short portion, the second antenna device being disposed in a space between the long portion and the short portion of the second passive element.

In the above-described communication apparatus, the first passive element may be disposed so that the long portion is substantially or nearly orthogonal to the first antenna device when viewing the first antenna device from the long portion of the first passive element. The second passive element may be disposed so that the long portion is substantially or nearly orthogonal to the second antenna device when viewing the second antenna device from the long portion of the second passive element.

With this arrangement, radio interference can be further suppressed. In all of the aforesaid embodiments, any element used in an embodiment can interchangeably be used in another embodiment unless such a replacement is not feasible or causes adverse effect.

According to at least the above aspect of the present invention, a very lightweight, simple, and inexpensive communication apparatus that can minimize radio interference even with a plurality of communication circuits and antennas can be provided. For purposes of summarizing the invention and the advantages achieved over the related art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

DESCRIPTION OF THE PREFERRED EMBODIMENTS

The present invention will be explained with respect to preferred embodiments. However, the present invention is not limited to the preferred embodiments The preferred embodiments are described in detail below with reference to the accompanying drawings.

Figure 1:
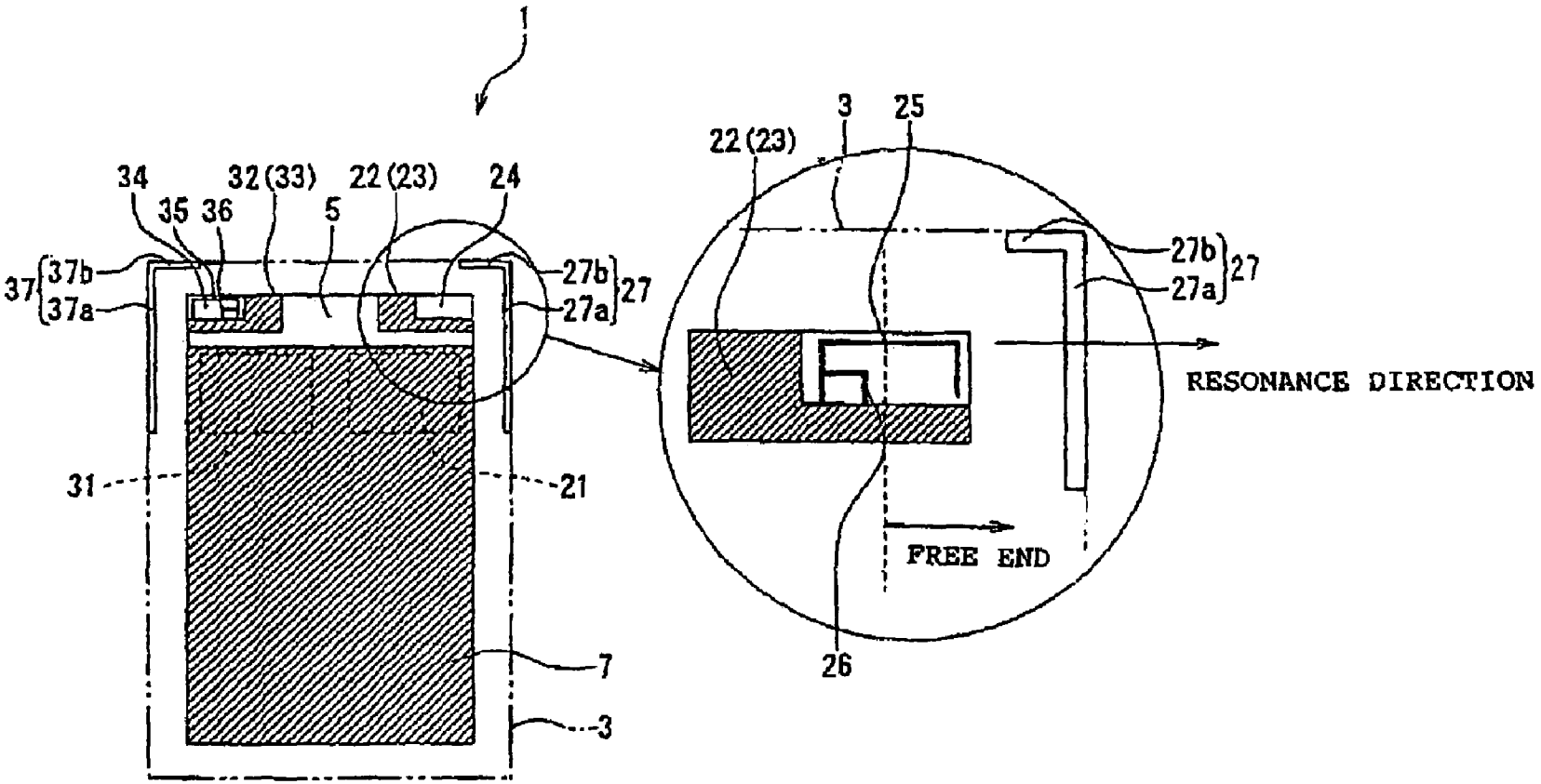
FIG. 1 is a front view illustrating a PDA, which serves as a communication apparatus.

A first schematic configuration of the communication apparatus is described below with reference to FIG. 1. A PDA 1, which serves as a communication apparatus, has a synthetic-resin casing 3 containing a motherboard 5. On the motherboard 5, a ground GND 7, a first communication circuit 21, a first antenna substrate 22, a second communication circuit 31, a second antenna 32, and various electronic components (not shown) serving as the PDA 1 are mounted. The first communication circuit 21 and the first antenna substrate 22 are used for Bluetooth®, while the second communication circuit 31 and the second antenna substrate 32 are used for a wireless LAN: both Bluetooth® and the wireless LAN use the 2.4 GHz.

In this embodiment, the first antenna substrate 22 is a rectangular, ceramic or synthetic-resin substrate. A first antenna ground 23 and a first chip antenna 24, which is a dielectric antenna, are disposed on one surface of the first antenna substrate 22. In this embodiment, a dielectric antenna is used for the chip antenna 24 because it can be reduced to a small size due to its high dielectric constant. However, another type of antenna may be used as the first chip antenna 24. The first chip antenna 24 may be provided with an inverted-F-type antenna formed of a first antenna device 25 having a length equal to about a ¼ wavelength and a first linear conductor 26 used for impedance matching. The reason for bending the end of the first antenna device 25 substantially or nearly at right angles is to reduce the size of the first chip antenna 24. The open end of the first antenna device 25 and the open end of the second antenna device are arranged in opposite direction with each other. With this arrangement, the direction in which the first antenna device 25 resonates (is excited) can be away from that of the second antenna device 35, namely, the null point of the first antenna device 25 can be directed toward the second antenna device 35, thereby minimizing radio interference.

In this embodiment, the inverted-F-type antenna is used partly because impedance matching can be easily provided simply by changing the length of the first linear conductor 26 used for short-circuiting the first antenna ground 23 and the first antenna device 25. Another type of antenna, for example, an inverted-L-type antenna, may be used as long as the resonance (excitation) direction of the first antenna device 25 can be away from that of the second antenna substrate 32 to suppress radio interference.

The first antenna ground 23 is formed generally in an L shape. This allows part of the first antenna ground 23 or a portion electrically connected to the first antenna ground 23 to intervene between the first chip antenna 24 and the GND 7 to block the connection therebetween. Accordingly, the first chip antenna 24 (first antenna device 25) can be protected from the influence of the GND 7 so that it can be stably operated. The first chip antenna 24 and the first communication circuit 21 are connected to each other by a transmission line, such as a radio cable (not shown).

The structure of the second antenna substrate 32 is similar to that of the first antenna substrate 22. That is, the second antenna substrate 32 is a rectangular, ceramic or synthetic-resin substrate, and a second antenna ground 33 and a second chip antenna 34, which is a dielectric antenna, are disposed on one surface of the second antenna substrate 32. In this embodiment, the second chip antenna 34 is provided with an inverted-F-type antenna formed of the second antenna device 35 having a length equal to about a ¼ wavelength and a second linear conductor 36 used for impedance matching (see FIG. 1). The reason for using the inverted-F-type antenna is the same as that of the first antenna substrate 22, in which case, another type of antenna may also be used. The second antenna substrate 32 differs from the first antenna substrate 21 in the following points. The free end of the second antenna device 35 is positioned at the left side of FIG. 1, while the free end of the first antenna device 25 is positioned at the right side of FIG. 1. This means that the second antenna device 35 and the first antenna device 25 resonate in opposite directions. Additionally, the second substrate 32 is used for a wireless LAN, while the first substrate 22 is used for Bluetooth®. However, the purposes of the first substrate 22 and the second substrate 32 may be reversed.

In a preferred embodiment, a first passive element 27, which may be generally an inverted-L shape waveguide device, includes a long portion 27*a* and a short portion 27*b* and is radiation-coupled with the first antenna device 25. More specifically, the first passive element 27 may be formed of conductive tape, which is attached to an inner wall of the corner of the casing 3. Since conductive tape is very thin, the first passive element 27 can be relatively easily installed without the need for a large space, and can also be attached to the inner wall surface of the casing 3 without the need for a special support member. Another material other than conductive tape, for example, a metal plate or a metal wire, may be used, and the installation place of the first passive element 27 may be changed according to the type of communication apparatus or installation environment. The long portion 27*a* is extended along the plane of the first antenna ground 23, and the short portion 27*b* is extended in parallel with the second antenna device 35 (in the direction opposite to the resonance direction of the first antenna device 25). The long portion 27*a* is substantially or nearly orthogonal to the resonance direction of the first antenna device 25.

Also, In a preferred embodiment, a second passive element 37, which may be an inverted-L shape, includes a long portion 37*a* and a short portion 37*b* and may be formed of conductive tape attached to the inner wall at another corner of the casing 3. The positional relationship between the second passive element 37 and the second antenna device 35 is the same as that between the first passive element 27 and the second antenna device 25.

A modified example of the above-described embodiment includes, but is not limited to, the configuration described below with reference to FIGS. 2 and 3. The PDA of the modified example may differ from that of the above-described embodiment only in the configuration of the passive elements. Accordingly, only a description of the passive elements is given, and the other elements are designated with like reference numerals without giving an explanation thereof.

Figure 2:
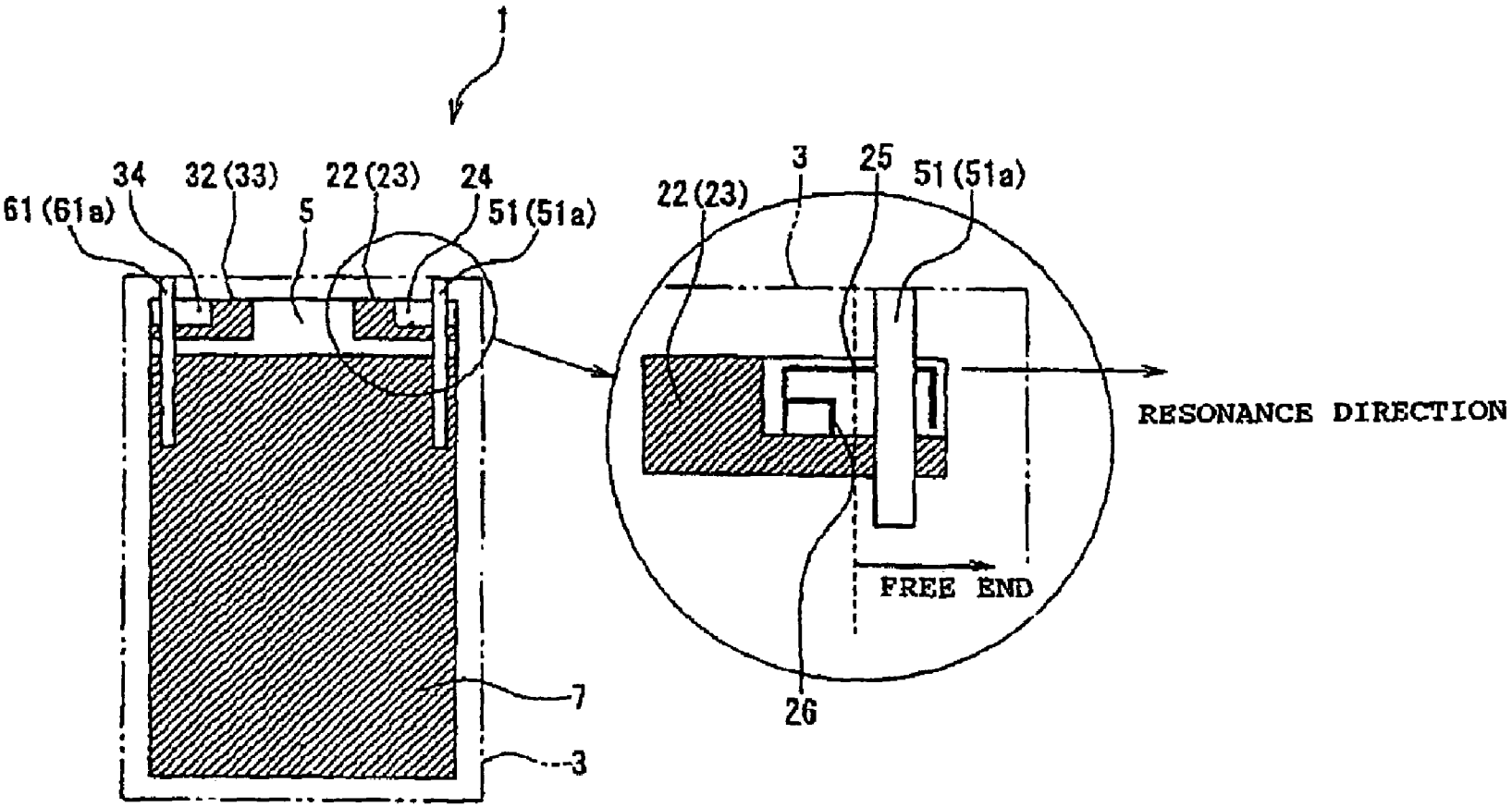
FIG. 2 is a front view illustrating a modified example of the PDA shown in FIG. 1.
Figure 3:
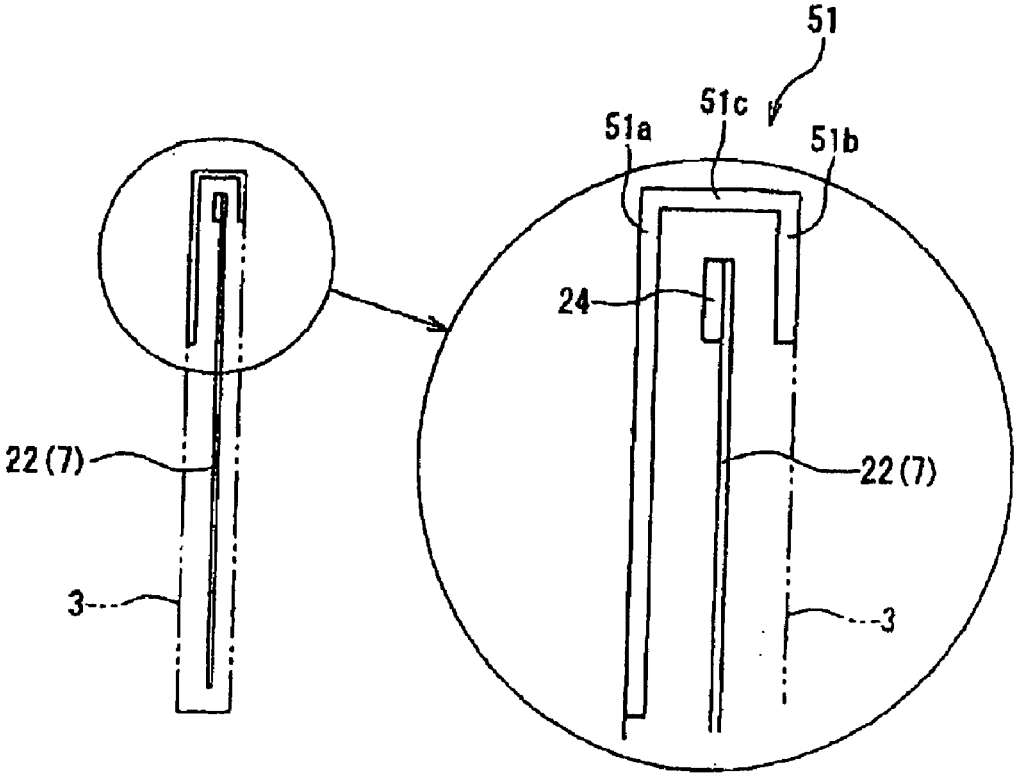
FIG. 3 is a right side view illustrating the PDA shown in FIG. 2.

A first passive element 51 shown in FIGS. 2 and 3, which is formed generally of an inverted-J shape, includes a long portion 51*a*, a short portion 51*b* facing the long portion 51*a*, and a connecting portion 51*c* for connecting the top of the long portion 51*a* and the top of the short portion 51*b*. As in the first passive element 27, the first passive element 51 may be formed of conductive tape and may be installed by being attached to an inner wall of the casing 3. The first antenna device 25 is disposed in the space between the long portion 51*a* and the short portion 51*b*. When viewing the first antenna device 25 from the long portion 51*a* of the first passive element 51, the first passive element 51 is disposed such that the long portion 51*a* is substantially or nearly orthogonal to the first antenna device 25. The structure of a second passive element 61 may be the same as that of the first passive element 51.

Figure 4:
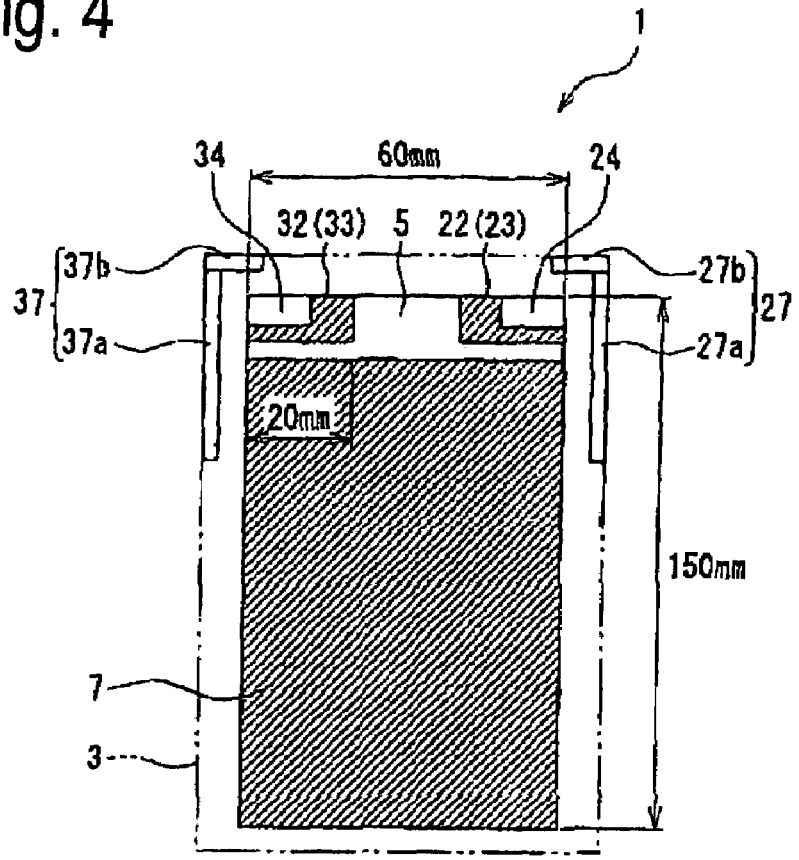
FIG. 4 is a front view illustrating a PDA used in a test.

The isolation level was examined by varying the configuration and the installation direction of the passive elements without changing the antenna substrate used in the PDA of the above-described embodiment and the PDA of the modified example. To examine the isolation level, a network analyzer (model 8753D by Agilent Technologies) was used to measure the attenuation of the electric field intensity when radio waves in the 2.4 GHz band supplied to the first antenna substrate 22 were received by the second antenna substrate 32. The results are discussed below with reference to FIGS. 4 through 11. The dimensions of the elements are shown in FIG. 4. The motherboard 5 had a width of 60 mm and a length of 150 mm, and the length of the antenna ground 22 or 32 was 20 mm.

Figure 5:
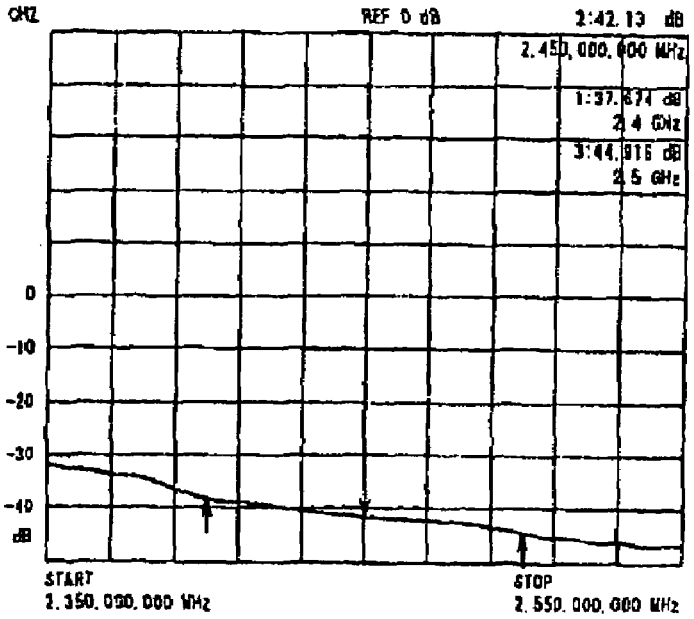
FIG. 5 is a diagram illustrating a characteristic of the PDA shown in FIG. 4.

The structure of the PDA 1 shown in FIG. 4 is the same as the above-described embodiment, that is, passive elements are formed generally in an inverted-L shape. With this structure, as shown in FIG. 5, the isolation level becomes lower than approximately −30 dB in the 2.4 to 2.5 GHz band, and becomes −37 dB in the 2.4 GHz band.

Figure 6:
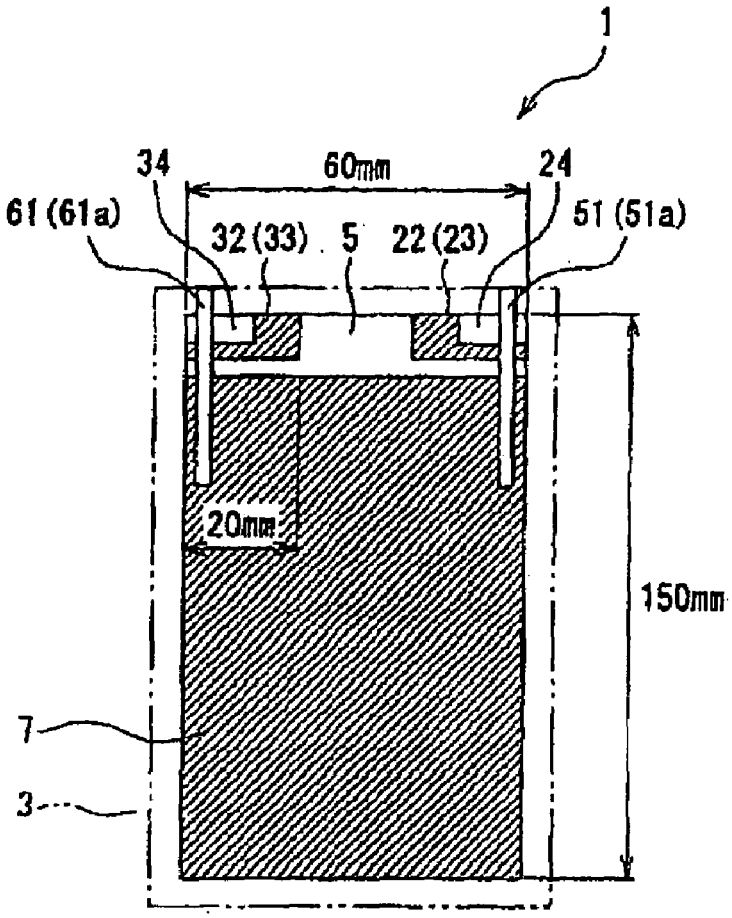
FIG. 6 is a front view illustrating a PDA used in the test.
Figure 7:
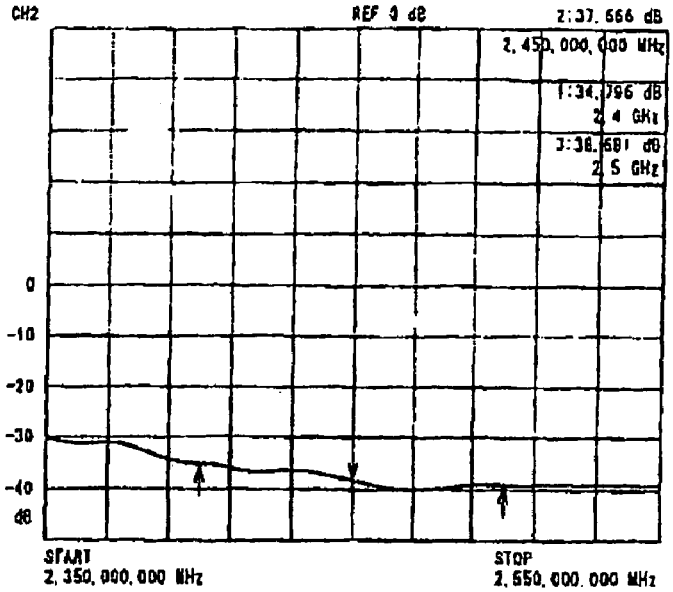
FIG. 7 is a diagram illustrating a characteristic of the PDA shown in FIG. 6.

The structure of the PDA 1 shown in FIG. 6 is the same as the above-described modified example, that is, passive elements are formed generally in an inverted-J shape. With this structure, as shown in FIG. 7, the isolation level becomes lower than approximately −30 dB in the 2.4 to 2.5 GHz band, and becomes −34 dB in the 2.4 GHz band.

Figure 8:
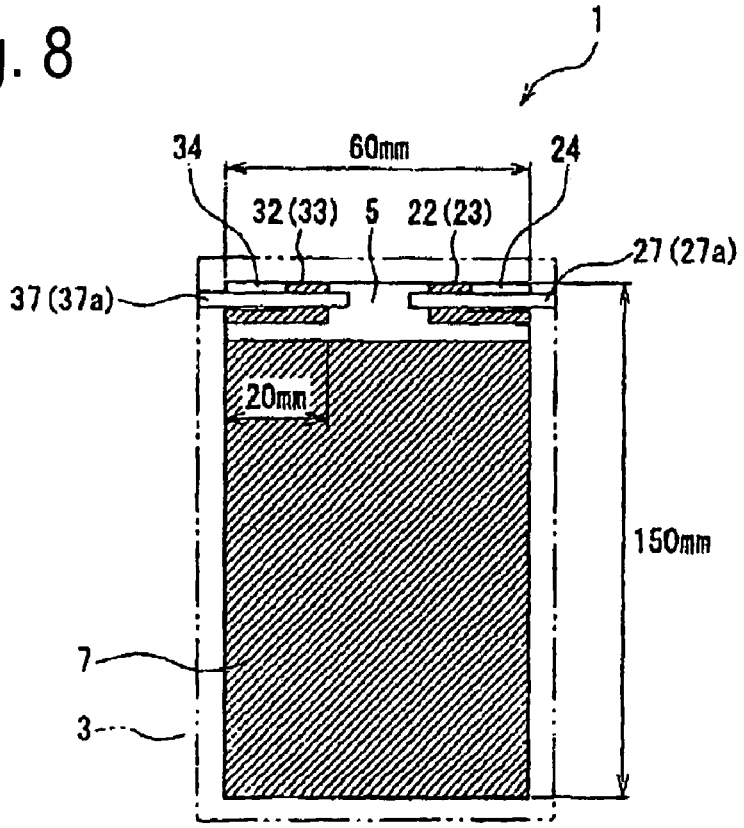
FIG. 8 is a front view illustrating a PDA used in the test.
Figure 9:
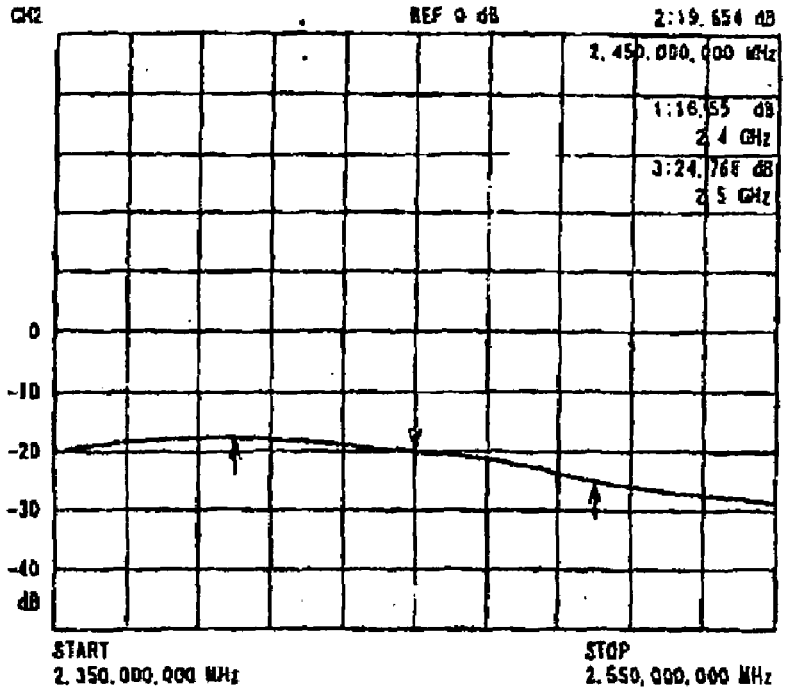
FIG. 9 is a diagram illustrating a characteristic of the PDA shown in FIG. 8.

The structure of the PDA 1 shown in FIG. 8 is an embodiment modified from the structure of the above-described embodiment. More specifically, long portions of inverted-L-shaped passive elements are disposed in the resonance direction of the antenna devices, i.e., in the horizontal direction in FIG. 8, and short portions are disposed along the thickness direction of the casing 3. With this structure, as shown in FIG. 9, the isolation level is not reduced much, and more particularly, only to −17 dB in the 2.4 GHz band.

Figure 10:
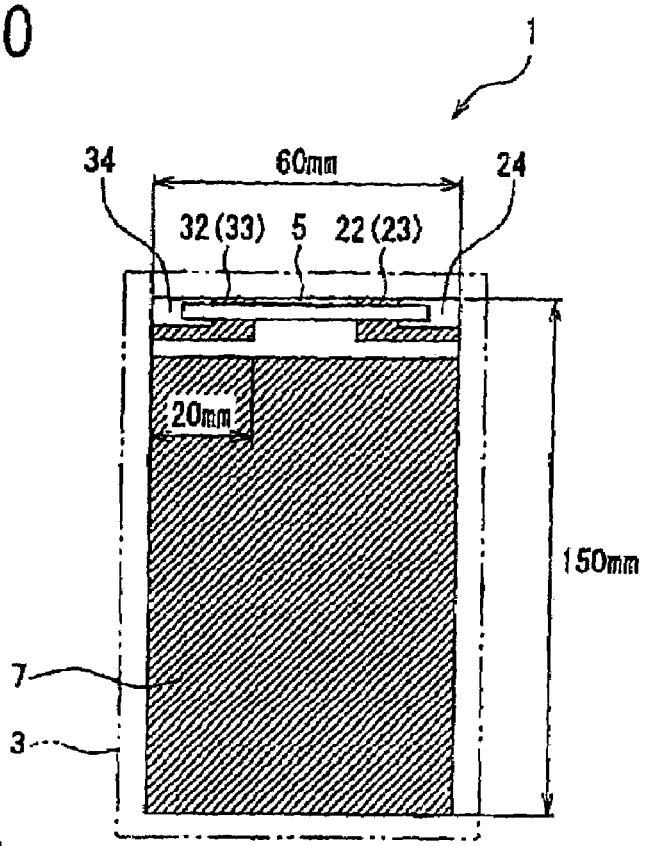
FIG. 10 is a front view illustrating a PDA used in the test.
Figure 11:
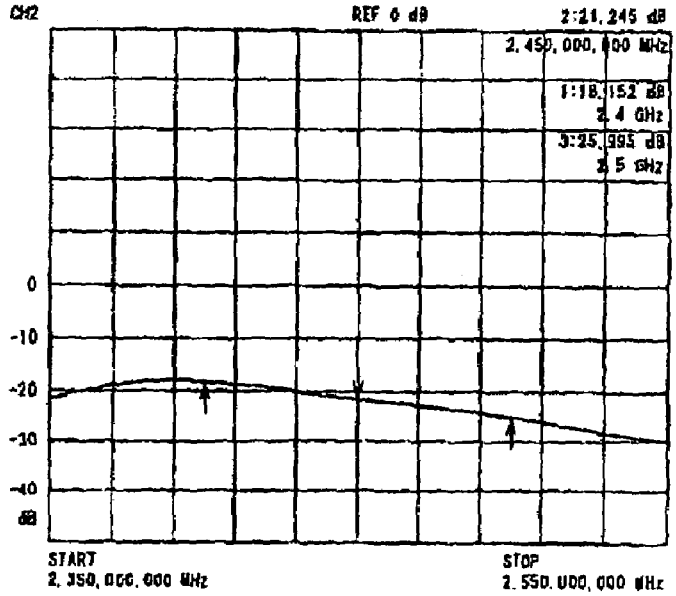
FIG. 11 is a diagram illustrating a characteristic of the PDA shown in FIG. 10.

In the PDA 1 shown in FIG. 10, only one passive element is disposed in the resonance direction of the first and second antenna devices. With this structure, as shown in FIG. 11, the isolation level is not reduced much, and more particularly, only to −18 dB in the 2.4 GHz band.

The above-described test results show that the passive element of the above-described embodiment shown in FIG. 4 and the passive element of the modified example shown in FIG. 6 are suitable for achieving an isolation level of −30 dB or lower in a communication apparatus in which the resonance direction of the first antenna is separated from that of the second antenna. However, even with the other passive elements in the test, the isolation level was reduced to −17 dB or −18 dB.

The present application claims priority to Japanese Patent Application No. 2003-320110, filed Sep. 11, 2003, the disclosure of which is incorporated herein by reference in its entirety.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A communication apparatus comprising:

a first antenna device;

a first communication circuit connected to the first antenna device;

a first antenna ground connected to the first antenna device;

a first waveguide passive element which is disposed on a free end side of the first antenna device and is radiation-coupled with the first antenna device;

a second antenna device;

a second communication circuit connected to the second antenna device;

a second antenna ground connected to the second antenna device; and a second waveguide passive element which is disposed on a free end side of the second antenna device and is radiation-coupled with the second antenna device, wherein the first antenna device and the second antenna device are configured to resonate in directions away from each other, wherein the free end side of the first antenna device and the free end side of the second antenna device are positioned away from each other.

2. The communication apparatus according to claim 1, wherein the resonance direction of the first antenna device and the resonance direction of the second antenna device are exactly opposite to each other.

3. The communication apparatus according to claim 1, wherein the first antenna device has a resonant frequency band close to that of the second antenna device.

4. The communication apparatus according to claim 3, wherein the resonant frequency band is the 2.4 GHz band.

5. The communication apparatus according to claim 1, wherein the first passive element is formed generally in an inverted-L shape including a long portion and a short portion, the long portion extending along a plane of the first antenna ground and the short portion extending in parallel with the resonance direction of the second antenna device.

6. The communication apparatus according to claim 5, wherein the long portion of the first passive element is disposed orthogonal to the resonance direction of the first antenna device resonates.

7. The communication apparatus according to claim 5, wherein the second passive element is formed generally in an inverted-L shape including a long portion and a short portion, the long portion extending along a plane of the second antenna ground and the short portion extending in parallel with the resonance direction of the first antenna device.

8. The communication apparatus according to claim 7, wherein the long portion of the second passive element is disposed orthogonal to the resonance direction of the second antenna device resonates.

9. The communication apparatus according to claim 1, wherein the first passive element is formed generally in an inverted-J shape including a long portion and a short portion, wherein a plane including the long portion and the short portion is orthogonal to the resonance direction of the first antenna device, and the first antenna device is disposed in a space between the long portion and the short portion of the first passive element.

10. The communication apparatus according to claim 9, wherein the long portion of the first passive element is disposed substantially or nearly orthogonal to the first antenna device when viewing the first antenna device from the long portion of the first passive element.

11. The communication apparatus according to claim 9, wherein the second passive element is formed generally in an inverted-J shape including a long portion and a short portion, wherein a plane including the long portion and the short portion is orthogonal to the resonance direction of the second antenna device, and the second antenna device is disposed in a space between the long portion and the short portion of the first passive element.

12. The communication apparatus according to claim 11, wherein the long portion of the second passive element is disposed substantially or nearly orthogonal to the second antenna device when viewing the second antenna device from the long portion of the second passive element.

13. The communication apparatus according to claim 1, further comprising a motherboard on which the first antenna device, the first communication circuit, the first antenna ground, the second antenna device, the second communication circuit, and the second antenna ground are disposed.

14. The communication apparatus according to claim 13, further comprising a common ground for the first communication circuit and the second communication circuit disposed on the motherboard, wherein the first antenna ground is formed in an L-shape interposing between the first antenna device and the common ground and between the first antenna device and the second antenna device, and wherein the second antenna ground is formed in an L-shape interposing between the second antenna device and the common ground and between the first antenna device and the second antenna device.

15. The communication apparatus according to claim 14, wherein the motherboard is enclosed by a resin casing.

16. The communication apparatus according to claim 14, wherein the first and second waveguide passive elements are disposed on an inner wall of the resin casing.

17. The communication apparatus according to claim 16, wherein the first and second waveguide passive elements are made of conductive tape.

18. The communication apparatus according to claim 1, which is a personal digital assistant or a notebook personal computer.

19. A communication apparatus comprising:

a first antenna device connected to a first communication circuit and a first antenna ground; and a second antenna device connected to a second communication circuit and a second antenna ground, wherein a resonate direction of the first antenna device is opposite to a resonate direction of the second antenna device, wherein the first antenna device is provided with a first waveguide passive element which is disposed on a free end side of the first antenna device and is radiation-coupled with the first antenna device, and the second antenna device is provided with a second waveguide passive element which is disposed on a free end side of the second antenna device and is radiation-coupled with the second antenna device, wherein the free end side of the first antenna device and the free end side of the second antenna device are positioned away from each other.

20. The communication apparatus according to claim 19, wherein:

the first passive element is formed generally in an inverted-L shape including a long portion and a short portion, the long portion extending along a plane of the first antenna ground and the short portion extending in parallel with the second antenna device; and the second passive element is formed generally in an inverted-L shape including a long portion and a short portion, the long portion extending along a plane of the second antenna ground and the short portion extending in parallel with the first antenna device.

21. The communication apparatus according to claim 20, wherein:

the first passive element is disposed so that the long portion of the first passive element is orthogonal to the direction in which the first antenna device resonates; and the second passive element is disposed so that the long portion of the second passive element is orthogonal to the direction in which the second antenna device resonates.

22. The communication apparatus according to claim 19, wherein:

the first passive element is formed generally in an inverted-J shape including a long portion and a short portion, the first antenna device being disposed in a space between the long portion and the short portion of the first passive element; and the second passive element is formed generally in an inverted-J shape including a long portion and a short portion, the second antenna device being disposed in a space between the long portion and the short portion of the second passive element.

23. The communication apparatus according to claim 22, wherein:

the first passive element is disposed so that the long portion is substantially or nearly orthogonal to the first antenna device when viewing the first antenna device from the long portion of the first passive element; and the second passive element is disposed so that the long portion is substantially or nearly orthogonal to the second antenna device when viewing the second antenna device from the long portion of the second passive element.

* * * * *